United States Patent [19]

Weinar

[11] Patent Number: 4,467,579

[45] Date of Patent: Aug. 28, 1984

[54] READILY SEPARABLE POSITIVELY LOCKING PANEL FASTENERS

[76] Inventor: Roger N. Weinar, 19 Parkside Ave., Hamburg, N.Y. 14075

[21] Appl. No.: 538,110

[22] Filed: Oct. 3, 1983

Related U.S. Application Data

[63] Continuation-in-part of Ser. No. 314,771, Oct. 26, 1981.

[51] Int. Cl.[3] ..... E04B 1/00

[52] U.S. Cl. ..... 52/281; 52/489; 52/713; 52/741

[58] Field of Search ..... 52/281, 489, 481, 713, 52/480, 509, 741

[56] References Cited

U.S. PATENT DOCUMENTS

| | | | |
|---|---|---|---|
| 4,194,336 | 3/1980 | Weinar | 52/509 X |
| 4,263,764 | 4/1981 | Wendt | 52/489 X |
| 4,377,060 | 3/1983 | Ragland | 52/489 |

*Primary Examiner*—Carl D. Friedman

*Attorney, Agent, or Firm*—Raymond F. Kramer

[57] ABSTRACT

Readily separable positively locking panel fasteners are described which are useful for holding panels together at sides thereof and to framing members; such as wooden or metal studs, to make walls, partitions or other structures incorporating side-abutting panels, such as wallboard panels. Mounting means for holding the panels together and to the framing member include engageable pairs of different panel fasteners, with one in each such pair being adapted to be held to a wallboard panel at a side thereof and to be fastened to a framing member, which fastener comprises a catch member, and to the other fastener of such pair being adapted to be held to another wallboard panel, which is to be installed in side-abutting or similar relationship to the other panel by means of fasteners which comprise a latch member which is engageable with the catch member of the other type of fastener.

20 Claims, 13 Drawing Figures

READILY SEPARABLE POSITIVELY LOCKING PANEL FASTENERS

This application is a continuation-in-part of my application Ser. No. 314,771, entitled CONCEALABLE WALLBOARD FASTENER AND WALLS AND PARTITIONS ASSEMBLED WITH THE AID THEREOF, which was filed on Oct. 26, 1981, and is incorporated herein by reference.

This invention relates to means for positively locking together and aligning panels, such as wall panels made of wallboard, and for holding them to framing members to produce a wall or similar structure, the panels of which are individually readily separable therefrom. More particularly, it relates to mounting means for holding such panels together in alignment with sides thereof abutting or essentially abutting, and for holding them to framing members, such as metal or wooden studs, which mounting means include different coengageable fasteners, one of which includes catch means and the other of which includes latch means. The fasteners are readily engageable and disengageable from each other and one of each pair, the latch fastener, is readily disengageable from the catch fastener by insertion of a blade or equivalent separating means between the latch and catch, so that the side of a panel containing latch fasteners springs away from the framing member and can be easily removed from the wall by pulling it away from and off the catch fasteners at the other end of the panel (the catch fasteners remaining held to the framing member).

Various conceable wallboard clips have been employed for mounting wallboard panels in side-abutting relationship on framing members to form walls. Some such clips include pointed tabs for holding the clips or fasteners to the sides of wallboard panels and some include openings through which screws, nails or similar fasteners may pass to hold such clips to framing members. However, installation and disassembly of such wallboard panels must normally be sequential, so that to remove a particular panel, when such is necessary to obtain access to plumbing, air-conditioning ducts, electrical terminals and telephone connections, it would be necessary, with various prior concealable wall assembly systems, to remove a plurality of panels, usually including an end panel, which might be sufficiently damaged during removal to require replacement. Among the various sequential or progressive wallboard assemblies and fasteners employed in them are those described and illustrated in U.S. Pat. Nos. 3,308,590; 4,117,644; 4,127,795; 4,221,095; 4,296,580; and 4,333,286. U.S. Pat. No. 3,922,764 discloses a latch type of clip with pointed barbs for fastening to a panel. The system of that patent permits individual panel removal and has found some acceptance in the marketplace but the clips thereof are only useful on I-shaped or H-shaped framing members, whereas the present invention is adaptable for use on various types of framing members. U.S. Pat. No. 3,852,927 discloses an apparatus for mounting wallboard wherein the mounted panels can be disengaged from each other by use of a screwdriver, but openings must be provided in the panels for insertion of the screwdriver, whereas such are not required by the present invention. Among other prior art of interest is German patent specification No. 7311486, which illustrates a fastening clip bearing a superficial resemblance to a clip of the present invention, but the clip of the German patent does not include any catch or latch means, such as are necessary for operativeness of the present invention, and the German patent clips do not function in the same desirable manner as those of this invention.

In accordance with the present invention a mounting means for holding wall panels together in readily separable positively locking relationship, and for holding them to a framing member, comprises a pair of different panel fasteners, each adapted to be held to wall panels at sides thereof by insertion of portion(s) of such fasteners into such sides, one such fastener being adapted for fastening to a framing member onto which the panels are to be held, such fastener comprising a catch member which, when the fastener is installed on a first wallboard panel, is next to a side of such panel and between it and an abutting side of a second panel, and the other fastener, which is installable on such second panel at the abutting side thereof, comprising a latch member adapted to be held by the catch member, which catch member and which latch member are of such construction that when the first panel, containing a plurality of the fasteners spaced apart and with the catch members at a side thereof, is held to a framing member, and the second panel, containing a plurality of the fasteners matchingly spaced apart, with the latch members at an abutting side thereof, is pressed against the framing member in abutting sides relationship with the first panel, the latch members will snap into place, engaged by the catch member and will positively hold the second panel to the framing member, in such relationship that the panels, when so held, are disengageable by insertion of a blade between them and between the engaged fasteners so as to release the second panel from the first panel and from the framing member. Sometimes a sideward force will also be exerted on the blade to assist in the release of the latch member from the catch. Also within the invention are individual catch-containing or catch fasteners and latch fasteners, mounting means adaptable for impaling fastening to wallboard panel sides, mounting means adaptable for use with T-, I- or H-shaped studs or framing members, and mounting means for installation on kerfed wallboard panels. The invention also includes walls, partitions or similar structures made from panels and fastened to each other and to framing members by means of the described fasteners and mounting means, and additionally it relates to a method of readily disassembling such a wall by insertion of a separating member, such as a broad bladed putty knife, between the coengaging fastener elements, to disengage the latches from the catches and move the panel with the fasteners containing the latches away from the other panel and into the room, so as to allow pulling of the latch fastener end of the panel away from the catch fasteners on the other end thereof, and off the framing member and out of the wall.

The invention will be readily understood by reference to the description in this specification, taken in conjunction with the drawing, in which.

Figure 1:
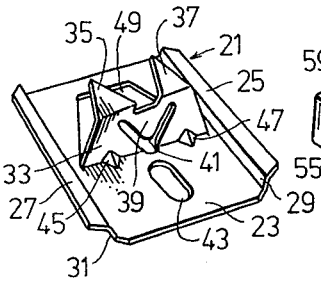
FIG. 1 is a perspective view of an embodiment of a strengthened impaling and spacing fastener of this invention which includes a catch member and is adapted to be fastened to a framing member.
Figure 2:
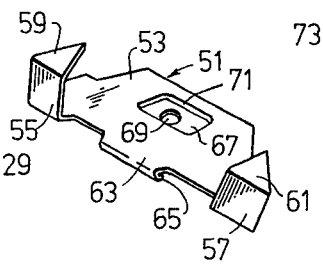
FIG. 2 is perspective view of an impaling fastener incorporating a latch member adapted to engage with the catch member of the fastener of FIG. 1 to hold together and in alignment along sides thereof, wallboards impaled by such fasteners.
Figure 3:
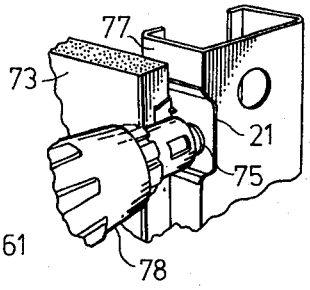
FIG. 3 is a perspective view of the catch fastener or clip shown in FIG. 1, impaling a wallboard panel and being power screwed to a framing stud, from which such panel is being spaced by the fastener.
Figure 4:
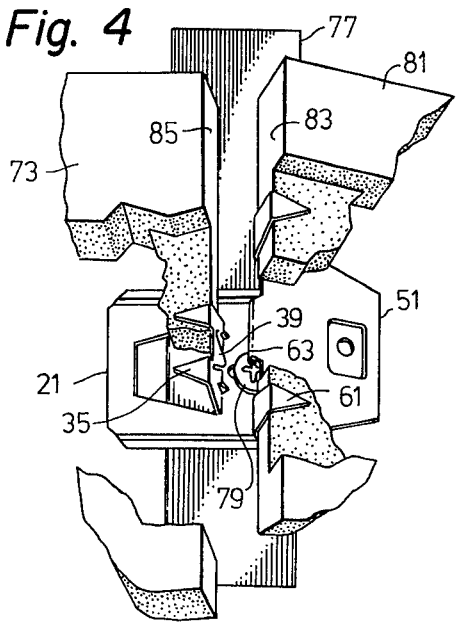

FIG. 4 is a pictorial representation, with portions being removed to show the locations of the fasteners, of the catch fastener shown in FIGS. 1 and 3, impaling a wallboard panel and being held to a framing stud, and the latch fastener, shown in FIG. 2, prior to engagement, or after having been disengaged from the catch fastener and having been moved away from the wall, prior to removal of its panel from catch members holding it to a framing member.

Figure 5:
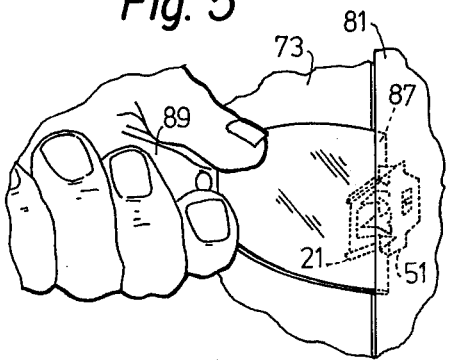
Figure 6:
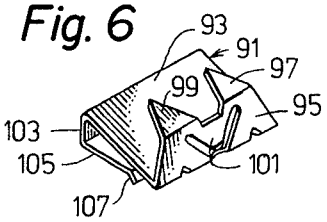
Figure 7:
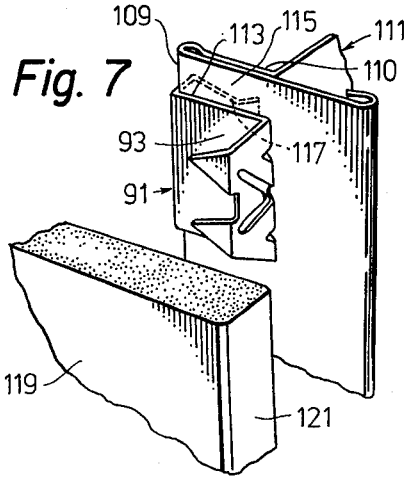
Figure 8:
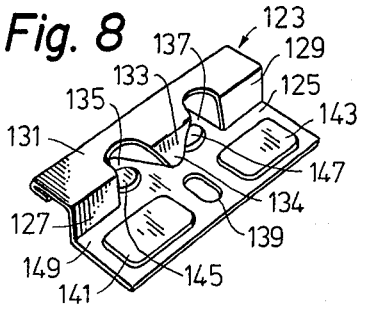
Figure 9:
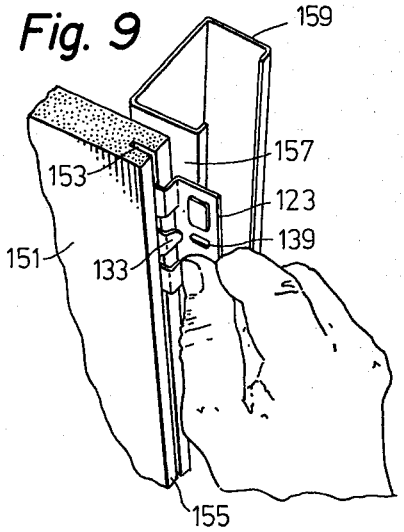
Figure 10:
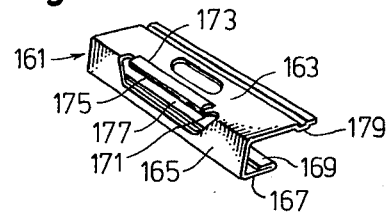
Figure 11:
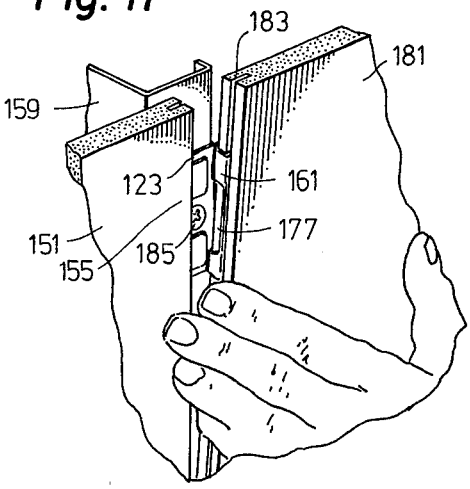
Figure 12:
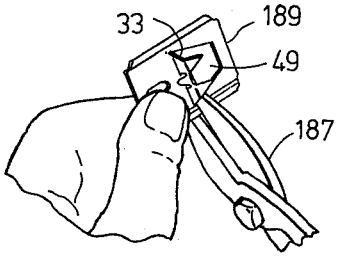
Figure 13:
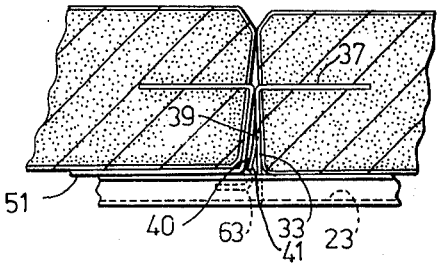

FIG. 5 is a perspective view showing the insertion of a putty knife blade between engaging fasteners to disengage the latch from the catch of the mounting means;

FIG. 6 is a perspective view of an impaling catch fastener which is adapted to be slipped onto an end of a T-, I- or H-shaped metal stud, so that employing of screw, nail or other such fastener is obviated;

FIG. 7 is a perspective view showing an assembly of a part of a T-shaped stud, the impaling catch fastener shown in FIG. 6, and a wallboard panel, with a portion of the wallboard panel having been removed, illustrating the relationship of such components when the panel is held to the stud by the fastener;

FIG. 8 is a perspective view of a catch fastener adapted for installation on a wallboard panel which has been kerfed on sides thereof;

FIG. 9 is a perspective view of a part of a wallboard panel, kerfed on a side thereof, with a catch clip of the type shown in FIG. 8 being installed on the panel side and with the panel and the clip being placed in position with respect to a metal framing stud prior to screwing such catch fastener to the stud;

FIG. 10 is a perspective view of a latch fastener adapted to engage with a fastener of the type illustrated in FIG. 8, and adapted for installation on a kerfed side of a wallboard panel;

FIG. 11 is a pictorial representation of a kerfed panel board containing a latch fastener of the type shown in FIG. 10 installed in a kerf in the side thereof just prior to being snap fitted into place to have the latch fastener engage a catch fastener, also shown in FIGS. 8 and 9, held to a framing member and another kerfed panel board;

FIG. 12 is a perspective view of a portion of the catch fastener of FIG. 1, being separated from the rest of such fastener, suitable for use as a corner clip; and FIG. 13 is a longitudinal cross-sectional view along a plane cutting through the catch and latch member portions of fasteners of FIGS. 1 and 2, as they coengage when assembled with panels and a framing member to form a part of a wall.

In FIG. 1 there is illustrated a catch fastener or clip which, with the latch fastener shown in FIG. 2, is a preferred embodiment of the invented mounting means for holding wall panels in alignment and to a concealed framing member, in the construction of a wall or partition. Catch fastener 21 is comprised of a base 23, rails 25 and 27, connecting, spacing and strengthening walls 29 and 31, web 33, impaling pointed tabs 35 and 37, and catch member 39, which is in concavely curved triangular form, with a rounded corner surface 41 adapted to engage with and bear against a ledge or latch member surface of a latch fastener, such as that illustrated in FIG. 2. Catch fastener 21 also includes an elongated centrally and longitudinal positioned slot 43 and strengthening reverse indentations 45 and 47 at the joinder of the base and the web. It will be noted that fastener 21 substantially corresponds to fastener 109 shown in FIG. 6 of my patent application Ser. No. 314,771. However, in the present fastener the slot is longitudinally positioned, rather than being transversely located. Such longitudinal slot facilitates the most desirable positioning of the catch fastener on the framing member. Because vertical movement of the catch fastener is not the mechanism for release of the latch member from the catch member when disassembling of a preferred wall of this invention is desired, a transverse slot is not needed.

In the catch fastener of FIG. 1, as is more clearly shown in FIG. 13, catch member 39, which is a pressed out portion which formerly was of web 33, extends toward base 23 and away from web 33 in a direction opposite to that in which the impaling tabs 35 and 37 extend. It will be noted that the web and impaling points of catch fastener 21 were initially part of a sheet metal (or other material) piece and, when removed from said sheet and shaped to form the web and tabs, left trapezoidal opening 49 in the base. As illustrated, web 33 is at a right angle to base 23 and tabs 35 and 37 extend at right angles to the web. If the curved catch member 39 is considered as straight (and sometimes it may actually be straight) the angle between it and the plane of the web will normally be in the range of 10° to 30°. However, other inclinations of the catch member may also be employed and catch members of other shapes and structures may be used, too. In the catch fastener illustrated the major surfaces of rails 25 and 27 that are visible will bear against the major back surface of the panel, the invisible surface of base 23 will bear against the framing member and the tabs 35 and 37 will be inserted in a side of a panel, such as a pre-finished wallboard panel. Such panel will preferably be angled at the sides thereof, so that the front edges (those seen by a viewer in the walled room) will abut each other, but the back edges of such panels will not be abutting and therefore a space will be left between the panel sides, in which the mounting means, particularly the latch and catch parts thereof, will be located.

In FIG. 2 a latch fastener 51 is illustrated, which is suitable for coengagement with the catch fastener of FIG. 1. Latch fastener 51 includes a substantially flat base 53, a pair of separated webs 55 and 57 extending at about right angles from the base, and a pair of tabs 59 and 61 extending at about right angles from the web. Latch means or ledge 63 extends a short distance (about 0.5 to 3 mm., e.g., about 1 mm.), past the plane of the visible web surfaces, so as to be engageable by catch member 39 of the mounting means (which is a combination of the catch and latch fasteners). However, other distances of extension may be employed and in some cases no extension is required, due to the design of the catch means (and it is within the scope of this invention to utilize various other catch and latch means, too). Latch member 63 is strengthened by being bent or folded back on itself (on a portion of the base, of which the latch member had been a part). Thus, it is seen that such "bent under" portion 65 of the latch, which may be crimped to the base 53 or may be merely curved, strengthens ledge 63 and additionally, the bending gives ledge 63 a desired rounded surface, facilitating snapping into place of the latch member when a removed wallboard is being reinstalled. In base 53 there is pressed a depression 67 with an opening 69 in it and with an intermediate strengthening wall 71 between it and the visible surface of base 53. Normally latch fastener 51 will not be held to a framing member by a screw or nail but in some instances the latch fastener can be used as a corner clip or end clip, in which case a flat headed screw or nail can be employed to hold the fastener to the framing member or other substructure. In such case the depression serves to keep the nail or screw head from projecting beyond the base surface, thereby preventing catching on the panel when it is being installed. If the depression is deep enough it can be in the same plane as the curled under portion of the latch, evening the mounting of the fastener on a framing member, but this is normally not necessary and often is not even desirable, because the slight differences in mounting angles are not apparent to the human eye once the wall has been assembled.

In FIG. 3 there is shown the installation of catch fastener 21 (previously impaled onto first panel 73) by the power driven installation of low head profile or pan head screw 75 in C-shaped metal channel stud 77 by screw gun 78. It will be noted that the catch fastener rails hold the wallboard panel 73 out of contact with stud 77, thereby making the wall to be produced acoustically superior to one wherein direct contact between wallboard and framing member or mounting stud is maintained. It will also be noted that such rails also will hold an abutting panel (to be installed) away from stud 77. In addition to being useful for holding panels onto the illustrated metal stud, the present mounting means can be employed to mount wall panels onto various other types of metal studs, including those of H-, I- and T-shapes and of any of various sizes. They are useful for mounting on wooden or synthetic organic polymeric plastic studs and other framing members. In this respect the present mounting systems are superior to those which are useful only on particular types of framing.

In the pictorial representation of FIG. 4 first panel 73 is held to stud 77 by catch fastener 21, which is tightly fastened to the stud by mounting screw 79. FIG. 4 shows an abuttable second panel 81 with latch fastener 51 impaled onto it, with the impaling points thereof penetrating a side 83 of the panel (just as the impaling points of catch fastener 21 penetrate side 85 of panel 73. It will be noted that panel 81, in FIG. 4, is not shown abutting panel 73 but, for purpose of illustration, is in a position just after removal of side 83 of the panel from framing member 77 and after disengagement of latch fastener 51 from catch fastener 21 (or in a position just before installation of panel 81 in abutting relationship with panel 73). If panel 81 is being removed from framing member 77 the panel will be moved in the direction of the room, after disengagements of the plurality of mounting means on that panel side, sufficiently so as to allow grasping of the panel side (that with the latch fasteners on it) and drawing of it away from the catch fasteners on the other side of the panel, and out of contact with such fasteners, whereby the panel is separated from the wall.

After such panel removal, which gives access to one or more of plumbing, air-conditioning ducts, electrical terminals, or telephone connections, or allows installation of such or other means, and after any work on the wall cavity is completed, the panel may be reassembled. In effecting such reassembly, the right side (not illustrated) of panel 81 will be lined up and slid onto the catch fasteners held to the framing member, from which the panel had previously been removed, and panel 81 will be pressed against stud 77, snap fitting latch member 63 to engage with catch member 39, so that surface 41 (see FIG. 1) of catch member 39 bears against the engaging surface of latch 63. Of course, this snap fitting operation will be repeated for all combinations of the mounting means holding panels 73 and 81 to stud 77.

It will be noted that panel 81 will not have its room surface (front major surface) in exactly the same plane as panel 73 because, due to the thickness of the base 53 of fastener 51, panel 81 is that much nearer to the room center. However, such a small variation, usually about 0.5 mm. or so, is almost undetectable. Still, if one wants the panels to be perfectly flush the rails 25 and 27 at the catch side of the fastener may be depressed a distance equal to the latching fastener base thickness.

Normal installation of the mounting means of this invention is with each panel having a series of catch fasteners along one side thereof and a series of latch fasteners along the other side. However, it is also within the invention, and sometimes it may be more desirable, to have both sides of a panel impaled with the same type of clips, with both sides of the abutting panels being impaled with the other type of clips. In such arrangement alternate panels would be held by screws, nails or other positive fasteners to framing members at both sides and the intermediate panels would not be so held. Thus, as will be illustrated in FIG. 5, the panel sides not screwed or nailed to the framing members are even more readily removed. However, to remove the panels equipped with catch fasteners on both sides would require unscrewings of fasteners holding the panel to the studs at one side. Yet, in those circumstances where a particular panel is known to enclose hidden utilities or other means to which access may be desired frequently (and it is not expected that abutting panels will have to be removed as frequently), the installation of latch fasteners only on the sides of the panel expected to be removed more often might well be highly preferable.

In FIG. 5 the extremely simple method of the present invention for initiating the removal of a wall panel which has been installed in positively locking relationship with an abutting panel, but is readily separable therefrom, is shown. All that is needed is for the latch member of latch fastener 51 to be disengaged from the catch member of catch fastener 21. Such is easily effected by insertion of a suitable separating member or disengaging means between mounting means of the abutting panels. In many cases, apparently due to the slight bowing or other curvature of the panels, mere insertion of a separating member, such as blade 87 of broad bladed putty knife 89, will be sufficient to cause disengagement of the mounting means and movement of side 83 (FIG. 4), of panel 81 in the direction of the room, thereby facilitating removal of the panel. In other cases, a relatively slight sideward force, usually only a few ounces or so, is applied to the blade or putty knife to disengage the component fasteners of the mounting means, and to release a previously positively held panel. Instead of the preferred broad bladed putty knife, putty knife blade or similar member other tools may be employed, providing that they perform the desired separating function. For example, screwdrivers, conventional putty knives, chisels and conventional knife blades may be employed but care should be taken to avoid marring the surfaces of the panels when such are used. Usually the separating means will be of a thickness of 0.3 to 1.5 mm., preferably 0.8 to 1.2 mm., and of appropriate width, such as 3 cm. to 10 cm., but useful separating blades of other dimensins may also be used.

The catch fastener of FIG. 6, like the other fasteners illustrated in the drawing described herein, is made from a single piece of sheet metal or similar material. The fastener 91 includes a base portion 93, the visible surface of which will be in contact with the back major surface of the panel, when installed. A web 95 extends at about a right angle from the base, and pointed tabs 97 and 99 extend at about a right angle from the web in the same general direction in which the tabs extend from the web. Catch member 101 is pressed out of web 95 in the same manner as was previously described with respect to the catch member and web of FIG. 1, and the web, the catch member, the tabs and the reinforcements between the base and the web of the fastener of FIG. 6 are essentially the same as those of the fastener of FIG. 1. However, the fastener of FIG. 6 includes means for slip fitting onto the end of a metal stud framing member or similar framing part. Thus, as illustrated, at the end of base 93 away from web 95 the sheet metal is bent to form a web 103, which is also bent at an end thereof to form a contacting and holding member 105, which is flared or opened at end 107 thereof. The combination of elements 93, 103, 105 and 107 may be considered as spring means, when made of spring steel, hardened steel or other suitable material, and such spring means are adapted to slip fit onto a flange or end portion 110 of a metal stud, as shown in FIG. 7. In FIG. 7 catch fastener 91 is shown holding onto end portion 110 and end 109 of the cross bar of the T-shaped stud 111. As is seen from the drawing, surface 113 of base 93 is in contact with major surface 115 of end portion 110 of stud 111 along substantially the entire length of surface 113, while at the confluence 117 of portions 105 and 107 of the fastener 91 contact is maintained with a hidden part of end portion 110, and a spring-like holding effect results. In FIG. 7 a portion of panel 119 is illustrated, which is impaled at side 121 thereof by impaling tabs 97 and 99 (FIG. 6).

The catch fastener 123 of FIG. 8 includes a base 125, a pair of webs 127 and 129, a tab portion 131 (equivalent in function to the pointed tabs of the fasteners of FIGS. 1 and 6, but adapted to fit into kerfed sides of wall panels), and catch means 133, extending from tab 131. The catch means, as illustrated, is concavely curved or flared, like the catch means of FIGS. 1 and 6, and is rounded at the contact surface 134 thereof, but other shapes of catch means may also be employed. Base 125 includes two portions, 135 and 137, which may be considered to be extensions of the main base, and which are adapted to contact a back major surface of a kerfed first panel, as illustrated in FIG. 9. Such base portions are each shaped substantially like the openings between the catch member 133 and webs 127 and 129, and in tab 131, and in the manufacture of this fastener such base portions are punched out from the sheet material, before bending to form the webs, tab and catch member. Fastener 123 includes a slot opening 139 and walled elevations 141, 143, 145 and 147. The walls of such elevations, between the elevated or raised surfaces which are nearer to panel surfaces (they contact them) than the base 125 and base parts 135 and 137, and the surface 149 of base 125, strengthen the fastener, help to inhibit distortions during heat treating of metal fasteners, and space the panel off the fastener base, to which it is held (as in FIG. 9). The elevations also provide clearances for screw or nail heads or for parts of other fastening means that pass through a slot 139. By having embossments 145 and 147 deeper (projecting more) than embossments 141 and 143, preferably by a distance equal to the thickness of base 163, the panels, such as panels 151 and 181 of FIG. 11, will be flush at their room surfaces.

In FIG. 9 there is illustrated the installation of fastener 123 or kerfed wallboard 151, which wallboard includes a kerf 153 in a side 155 thereof. Also shown in the positioning of fastener 123 against a face 157 of C-shaped metal channel stud 159 prior to drive screwing fastener 123 onto such stud through slot 139.

In FIG. 10 latch fastener 161 is shown in inverted position with respect to its fitting with catch fastener 123 of FIG. 8. This is done so as better to show details of catch member 173. In fastener 161, base 163 has web portion 165 extending at about a right angle from it, and from the web portion tab member 167 extends at about a right angle, which tab is bent over at end 169 thereof. An extension 171 of base 163 is bent over at end 173 thereof to form ledge or latch member 175, and to leave opening 177 in web 165. Tab portion 167 is adapted to be fitted into a kerf at a side of a panel board, with the hidden portion of web 165 contacting the side of such panel board. Base 163 includes a rib 179 near the end thereof for strengthening the base to help to hold fastener 161 to the kerfed panel board and to minimize distortion during heat treatment. Such rib may extend toward or away from the plane of tab 167. A centrally positioned longitudinally extending slot may be located in base 163, to "overlie" a portion of slot 139 in catch fastener 123. Such may be especially useful when elevated portions 141 and 143 (and also 145 and 147) are not present, and it allows better alignment of the wall panels by providing a nest for a fastening means head and decreasing the misalignment of the panels due to a need for one panel (which is numbered 181) to clear the fastening means head.

In FIG. 11 there is illustrated the fitting into place of kerfed panel 181 with latch fastener 161 held to it and in kerf 183 thereof in such position that latch member 177 will be capable of engaging catch member 133 (not shown in FIG. 11, but see FIG. 9) when panels 151 and 181 are in abutting relationship. As is seen in FIG. 11, screw 185 is holding catch fastener 123 to stud 159 and such catch fastener is installed at a side 155 of panel 151.

FIG. 12 illustrates the conversion of the catch fastener of the type shown in FIG. 1 to a corner clip, useful for fastening a wall panel to a framing member at a corner, such as at the beginning of a second wall. As shown, snips 187 are cutting off from the catch fastener the base portion designated 189, which is opposite to the catch side of web 33, and are also cutting off the accompanying rail portions and intermediate walls on that side of the web. To start a wall from a corner a plurality of corner clips of the type described are assembled on the framing stud with impaling tabs pointing against the direction the wall is to run, and impaling the already assembled wall in known manner. The fasteners are fastened to the corner stud, as by screws through the slot, and then a panel having latch fasteners on a side thereof and spaced to fit the corner clips, may be fitted into place, with latch members therof engaging the catch members of the corner clips. Normally, for all the mounting means, they will be spaced five units along an eight foot height of panel, with the spacings being about every 1½ feet, and with fasteners about one foot from the panel's tops and bottoms. In some instances the catch fastener may be used as a corner fastener, without modification, with the pointed tabs (or kerf-fitting part) pointing in the direction in which the wall is to run, from the corner. However latch fasteners are useful only as starting corner clips and the modified catch fasteners should be employed as the ending clips because a panel with latch fasteners held to it can be snap fitted into place to finish the last wall of a room, with the latches fitting the corner clip catches.

In FIG. 13, a sectional view of the positively locking assembly of catch and latch fasteners, panels, stud and fastener screw of FIG. 4, the various parts thereof are identified as in FIGS. 1 and 4. Specifically, it will be noted that catch member 39 is concavely curved from web 33 along surface 40 at about an angle of 15° (straight line equivalent) to the web in a direction toward the base 23 and opposite to the direction in which tabs 35 and 37 extend. In such form it has been found that excellent positive locking with readily releaseable engagement is obtained with latch 63 of latch fastener 51. The curvatures of the latch and catch members facilitate snap fitting of removed panels back into place and the rounded point contact of the catch 39 at 41 (the part of the catch nearest to base 23) with ledge or latch 63 positively holds the abutting panels in alignment and to the framing member so that such panels are not removable by external blows, vibrations, saggings or distortions of the panels or other normally encountered shocks that may be transmitted to the panels. Unlike other removable wallboard panels (including those held by catch and latch type fasteners), due to the described latch and catch constructions of this invention, and their cooperation, the present panels are not removable from a walled room by pressure applied against them at desired locations or by pulling forces. Nor are they removable by force exerted from the wallboard cavity, as when panels on the other side of the stud are removed to give access to the back major surfaces of the panels of the present walls. Yet, they are readily removable by insertion of a blade-like object between fasteners, sometimes with slight movement of the blade to separate the latch and catch portions of the fasteners and cause their disengagement. Such removal does not require special panel constructions nor does it necessitate the use of special tools or the changing of panel appearance.

Preferred embodiments of the invention have been illustrated in the drawing and such embodiments have been described in the preceding portion of this specification, but it must be clearly understood that variations of the invention may also be employed and parts of the various fasteners may be interchanged and substituted to create hybrid fasteners which will be capable of operating in essentially the same manner as those illustrated or with various combinations of their properties. The fasteners are primarily intended for employment in assembling pre-finished wallboards, especially those which measure four feet by eight feet and which are normally of thicknesses in the range of ⅜ inch to 1 inch, e.g., 178 inch to ¾ inch, but they may be used for other types of wallboards and panels and for wallboards of other sizes. Also, they may be useful for mounting wood paneling sheets and other paneling materials, and the dimensions of the fastener clips and the dimensions and shapes of the impaling parts may desirably be changed when the clips are adapted for the installation of wood, polymeric plastic foam core, paperboard, fiberboard, honeycombed and other types of such paneling. The invented fasteners may be utilized in the constructions of ceilings and of horizontal, vertical and inclined walls and partitions, when it is preferred that such have panels thereof which are readily individually demountable and remountable.

Although the fasteners are usually of sizes from 2 to 5 cm. in length, and 3 to 7 cm. in width, fasteners of sizes outside such ranges are also considered to be useful and are within the invention. Similarly, sheet metal thicknesses for the fasteners will generally be from 0.5 to 1 or 2 mm., especially about 0.6 to 0.8 mm., but for some other materials they may be as great as 3 or 4 mm. The depths of any strengthening and spacing walls of the fastener clips will usually be at least ¾ of the thickness of the sheet or strip material of which the clip is made and the wall thickness and thicknesses of the various clip parts, which are made from the same sheet material, will normally be about that same thickness. While some strengthening and spacing wall depths may be up to ten times the sheet metal thickness, normally depths of the walls will be from ¾ to 5 times the metal thickness, e.g., 1 to 3 times such thickness, and most often will be sufficient to provide clearance for the head or other projecting part of a screw or other suitable holding means, intended for holding the fastener clip to a substructure member.

Various parts of the fastener clips are normally parallel to each other or at right angles to each other, as illustrated in the drawings, wherein the bases and tabs are normally parallel and the webs are normally at right angles to these. However, in some instances the tabs may be inclined to the web at lesser angles to help them to hold to particular panel materials. Also, the reinforcing and spacing walls and the panel contacting and substructure contacting surfaces, especially at rails or ribs, may be angled or rounded.

The fasteners of this invention are preferably made of single pieces of sheet material but it is within the invention to utilize a plurality of parts held together to form the individual clips. The material of choice is hardened spring steel, such as SAE 1050 high carbon spring steel (1030–1060 may also be employed), which is annealed before forming and after forming is heat treated (hardened) to a Rockwell hardness in the range of C-24–34, preferably C-28 or C-30. However, it is within this invention to utilize other suitable materials, such as sheet steel, other sheet metals, including aluminum and magnesium-aluminum alloys, synthetic organic polymeric plastics, such as nylons, acrylates, fiberglass reinforced polyesters, and engineering plastics, when suitable. Such materials of construction may be molded or otherwise shaped to form, but perferably, when metal is being utilized, an essentially flat piece of material stamped or cut to desired pattern, punched out, when that is appropriate, and bent, will be employed. The various rails, webs, tabs, catches, latches and impaling points may be stamped out from base portions of the fasteners or may be bent from extensions thereof, and the various slots, openings and channels may be varied in size and shape, including degrees of "oversize". Different manufacturing methods make it possible to further modify and improve the structures of the present clips, and to increase production efficiency. For example, the clips may be partially formed by extrusion or roll forming instead of being cut and bent, and subsequently bends may be made and holes or slots may be punched out, after which they may be hardened.

While it is within the invention to install the fasteners in the wallboard prior to shipment to the job site, and such installation may be with the aid of adhesives, glues, cements and thermoplastic fastening means, it is primarily intended for the clips to be installed in the wallboards and for the boards to be joined together by means of them at the construction site, and for such installations to be by the craftsmen constructing the wall.

Various significant advantages attach to the employment of the present fastener clips and to the walls constructed with them and the held wallboards or panels. The fasteners, when being used alternatively on abutting wallboards, may all be of the same type, with the fasteners on one side of a wallboard only being held to the substructure. In such progressive use the catch fasteners may be used like prior art clips like those shown in my U.S. Pat. No. 4,117,644. As was prevously mentioned, it is within the invention to have adjacent panels contain different fasteners (one having all catches and the other all latches). Sometimes not all of such fasteners on a held side have to be fastened to the substructure and sometimes some such fasteners may be omitted, with the remaining fasteners, on the abutting wallboards, serving satisfactorily to align the wallboards. Utilizing longitudinally rigidifying rails, ribs, depressions, elevations or tracks stiffens the fasteners so that they can satisfactorily resist installation forces, as from a hammer, and allows application of such forces on the fastener end, rather than on the web, thereby making the hammering easier and less likely to result in objectionable marking of the wallboard. Tools for this purpose may also be made and employed, usually in conjunction with a hammer. Also, the mentioned reinforcements may help to prevent distortions of the fastener during heat treatment thereof, and they tend to maintain the structure of the fastener in use, resisting bending.

Rigidifying of portions of the clip may be effected to prevent any possible twisting of the clip under strain but often such will not be utilized because the structure of such clips, particularly when they are rectangular in shape, with continuous sections of sheet metal connecting longitudinally external rails, gives the fastener sufficient strength to resist distortion during normal installation and use. Of course, the presences of slots, oversized holes or other openings facilitates positioning of the clip as desired for holding to a substructure by a suitable fastener. The web, tab, rail, reinforcement, catch and latch portions of the fastener are from the base portion thereof so no additional metal is needed for such parts, and removal of the metal for such parts from the base does not seriously weaken the fastener. Also, when the essentially rectangular shape of some of the fasteners is adopted there is little or no waste in cutting the blanks from a larger metal sheet.

In the aspect of this invention wherein catch and latch clips which interconnect are employed alternately on different abutting sides of adjoining wallboards, with all of one type on one such side and all of the other on the other such side, and with such alternation continuing down the wall length, it is no longer necessary to begin a dismantling (or installation) operation at a corner of a wall or to have a wallboard noticeably marked or damaged during removal (or batten stripped during installation). With the present complementary clips, disassembly may be at any location desired and only a single panel has to be removed, although adjoining panels may also be readily disassembled from the wall. Then, when the panel is to be reinstalled, it may often be snapped in place or guided into position, sometimes with the fastenings of several screws or nails also being required.

The present clips possess various structural advantages over other clips used to make walls containing readily individually disassemblable panels. By locating of the catch and latch features as parts of, on, at or near the web portions thereof, the latch and catch parts are stabilized and any accidental release thereof due to bending forces, as might possibly occur if they were at clip ends, is prevented. The web structures are strengthened in use because the webs are held together and in place between the abutting wallboard sides. Such abutting wallboard sides, being slightly tapered, with the contacting portions thereof at the front faces, provide room for the latch and catch clip portions to be inserted between them, because such portions are toward the backs of the wallboard sides, where the larger openings are present. Thus, the projections from the web of the latch and catch parts do not hold the wallboards apart and good contacts between them at their front major surfaces (or near such surfaces) are obtained. Also, the tapering of the wallboard sides mentioned, which is usually at an angle between 60° to 85°, allows uses of various catch and latch clips of the types described, despite their projections from the web portions thereof. The catch clips can also be used in place of the latch clips when it is not necessary for particular panels to be independently readily dismantlable. To clarify that, instead of pairs of fastener clips and complementary clips being removably fitted together to hold the wallboards or panels in alignment and to a substructure, the fastener or catch clips may be employed in the manner described in U.S. Pat. No. 4,117,644.

Use of the invented fasteners is very simple. For example, when alternating catch and latch clips are to be employed in the construction of a wall, with the assembly going from left to right, after installation of the corner clips on the left side of a wallboard and the catch clips on the right side thereof, these are fastened to framing members. Then the next panel, with latch fasteners on the left side thereof and catch fasteners on the right side thereof, is slid into place, with the latches engaging the catches of the previously installed panel, and the catches of the second panel are screwed or nailed or otherwise fastened to the appropriate stud. This procedure is continued until the wall is finished and then the nex wall, at 90°, is begun, with appropriate corner clips being employed to hold the first panel of the second wall to the last panel of the first wall and to a corner framing member. Alternatively, instead of fitting the latch fasteners of the second panel to catch fasteners of the first panel and then joining catch fasteners of the second panel to the framing member, catch fasteners of the second panel may be joined to the framing member while the latch fasteners at the left side of the second panel are not engaging the catch fasteners of the first panel. In such operation the left side of the second panel board may be appropriately positioned, extending into the room, and after the catch fasteners on such panel are positively joined to the framing member the left side thereof may be snapped into place. As the assembly proceeds, the installer may check the installation by pressing against the abutting sides to see whether the wallboards are disengageable (if they are they should be installed closer together) and by insertion of a putty knife blade to separate the fasteners slightly and make sure that they are readily disengageable when desired.

Instead of beginning at a corner, one may begin the installation at a middle portion of a wall and may progress in both directions from that location. Often it may be desirable to begin with a panel having latch members on both sides and install on both sides of it panels containing catch members on both sides thereof, and repeat the operation so that although the panels are latch-catch joined, individual panels contain only one type of fastener. Thus, alternate panels will be very readily accessible, without the need to remove any of the catch fasteners from the panels when the individual panels containing only latch fasteners are removed from the wall.

The advantages of the present invention are so significant that it is considered that it will revolutionize the assembly of pre-finished wallboard panels to form walls in which the panels are positively locked together but are readily removable when desired. In office buildings this will allow access to utilities in the spaces between walls. Repairs and alterations will be able to be effected while work continues uninterrupted in office spaces, showrooms, stores and other work areas. No longer will it be necessary to disassemble an entire wall to remove a particular panel, and no longer will it be necessary to mar the surfaces of such panel during the removal process. The same panel that is removed will be replaced and it will be just as positively fastened and readily separable as when it was first installed. No replacememnt panels will be needed which, after the passage of years, may no longer be available in the surface design of the wall, and if available, may be of a different color shade. It will not be necessary to keep an inventory of replacement panels on hand. The various latch and catch fasteners are suitable for use with all types of framing members, although some of the invented fasteners may be designed for use on specific framing members. Thus, fasteners like those of FIG'S. 1–5 and 13 may be employed on wood, plastic or metal studs, of various shapes. No special type of framing members and no complicated mounting means are needed. Off-the-shelf components may be employed, which are familiar to mechanics and are available everywhere at competitive prices. The fasteners of FIG'S. 6 and 7 tend to remain with the panel when it is removed, which is an advantage because they do not have to be repositioned in the panel for replacement thereof, and the holding power of the fastener on the panel is maintained. The fasteners of FIG'S. 8–11, adapted for use with kerfed panels, allow replacements of panels without fittings of the tabs to relatively small openings previously made in the panel sides by the pointed tabs. The demountable walls and partitions made with any of the invented fasteners and mounting means are attractive and by virtue of their easy assembly by relatively unskilled mechanics, using standard framing members and panel materials with the present inexpensive and readily installable fasteners, there is obtainable a pre-finished wall with the space behind any panel being readily accessible, and such can be built for very little more than the cost of an ordinary, conventional, non-demountable gypsum board wall. Yet, every panel in such system, in effect, is a door, giving ready accessibility to the space behind, which accessibility is becoming a practical necessity in many buildings, especially in modern office buildings where different telephone and electric panel installations may be made frequently, as personnel and office changes occur. Additionally the present invention allows easy changing of the decor of an office, store or salesroom without the loss of replaced panels, which can be used elsewhere.

Walls made in accordance with the present invention will be satifactorily aligned and will not exhibit warping or bowing at joints, which could be objectionably apparent to a room occupant as shadows at such joints. The positively locking system of the present invention overcomes the normal tendency of removable panel boards to warp where held to a framing member and therefore the present walls are more attractive than those disassemblable walls of the prior art. The pre-finished wall produced, is available in various materials but normally textured vinyl sheet-covered gypsum panel boards will be preferable. The panels fit together so closely, with only hairline joints being apparent, that they may often give the impression of a continuous wall. Of course, the fasteners are invisible. Batten strips or angles may be employed for tops, bottoms and corners of the walls made according to the invention but their use can be limited to external corners. However, top and bottom batten strips may often be employed for other reasons too, such as to cover unevenly fitting panels at the floor and ceiling and to provide protection of the panels against floor level contact with cleaning equipment, such as vacuum cleaners and carpet shampooers. If the wall panels are additionally held to framing members at the base and top thereof by positive fastening means, such as screws, such may be removed, together with the present fasteners, to obtain access to the space behind the wallboard, and may be replaced when the panel is reinstalled, without any problems, the screw heads being covered by the batten strips. Similarly, corner battens will cover the screwheads if corner clips, such as those described herein, are not employed.

The invention has been disclosed with respect to descriptions and illustrations of preferred embodiments thereof but is not to be limited to these because one of skill in the art, with the present specification before him, will be able to utilize substitutes and equivalents within the invention.

What is claimed is:

1. A mounting means for holding wall panels together in readily separable positively locking relationship, and for holding them to a framing member which comprises a pair of different panel fasteners, each adapted to be held to wall panels at sides thereof by insertion of portion(s) of such fasteners into such sides, one such fastener being adapted for fastening to a framing member onto which the panels are to be held, such fastener comprising a catch member which, when the fastener is installed on a first wallboard panel, is next to a side of such panel and between it and an abutting side of a second panel, and the other fastener, which is installable on such second panel at the abutting side thereof, comprising a latch member adapted to be held by the catch member, which catch member and which latch member are of such construction that when the first panel, containing a plurality of the fasteners spaced apart and with the catch members at a side thereof, is held to a framing member, and the second panel, containing a plurality of the fasteners matchingly spaced apart, with the latch members at an abutting side thereof, is pressed against the framing member in abutting sides relationship with the first panel, the latch members will snap into place, engaged by the catch member and will positively hold the second panel to the framing member, in such relationship that the panels, when so held, are disengageable by insertion of a blade between them and between the engaged fasteners to release the second panel from the first panel and from the framing member.

2. A mounting means according to claim 1 wherein the fastener comprising the catch member is a spacing fastener made of a single piece of material, is adapted to hold the panel, to which it is held, away from the framing member, and comprises a base adapted to contact the framing member and the back major surface of the first panel, a web extending from the base and away from the framing member, when installed, at about a right angle from the base, and at least one impaling tab extending from the web so as to be capable of impaling the side of the panel, with the catch means being a portion of the fastener displaced from the web, with a catching surface thereof being the nearest part thereof to the base and to the framing member when the fastener is installed on the framing member, and with the catch extending from the web in a direction toward the fastener base and opposite to that in which the impaling tab(s) extend(s) from the web.

3. A mounting means according to claim 2 wherein the fastener comprising the catch member is of spring steel and comprises a pair of pointed impaling tabs, and the catch is substantially triangular in shape, with the catching surface thereof being a rounded corner of said triangle.

4. A mounting means according to claim 3 wherein the fastener comprising a latch member is made of a single piece of material, comprises a base adapted to contact a major back surface of the second panel, on which the latch fastener is to be installed, a pair of separated webs extending from the base and away from the framing member, when installed, at about a right angle from the base, a pair of impaling tabs extending at right angles in the same direction from said webs so as to be capable of impaling the side of the panel, and a ledge-shaped latch member extending from the base between the webs.

5. A mounting means according to claim 4 wherein the fastener comprising the latch member is of spring steel, the ledge extends from the base in a direction opposite to that of the impaling tabs, and the ledge is strengthened and rounded near the end thereof by having the material thereof bent back on itself.

6. A mounting means according to claim 1 wherein the fastener comprising a catch member includes means for slip fitting onto an end of a metal stud framing member.

7. A mounting means according to claim 6 wherein the fastener comprising the catch member is made of a single piece of material, comprises a base adapted to contact the framing member and the back major surface of the first panel, which base at one end it bent so as to form a generally U-shaped means for slip fastening onto an end of a T-, I- or H-shaped stud, and at the other end has a web extending from the base and away from the framing member, when installed, at about a right angle from the base, and at least one impaling tab extending from the web so as to be capable of impaling the side of the first panel, with the catch means being a portion of the fastener displaced from such web, with a catching surface thereof being the nearest part thereof to the base and to the framing member when the fastener is installed on the framing member, and with the catch extending from the web in a direction toward the fastener base and opposite to that in which the impaling tab(s) extend(s) from the web.

8. A mounting means according to claim 7 wherein the fastener comprising the catch member is of spring steel, the means for slip fitting the catch member fastener onto the end of the T-, I- or H-shaped stud includes spring means near an end thereof for pressing against such stud and holding the fastener to it, such fastener comprises a pair of pointed impaling tabs, and the catch is substantially triangular in shape, with the catching surface thereof being a rounded corner of said triangle.

9. A mounting means according to claim 1, which is adapted for mounting kerfed panels, having kerfs at sides thereof, to a framing member, wherein the fastener comprising the catch member is made of a single piece of material and comprises a base adapted to contact the framing member and a back major surface of the first panel, a web extending from the base and away from the framing member, when installed, at about a right angle from the base, a tab member extending from the web so as to be capable of fitting in the kerf in the side of the first panel and, in conjunction with a part or parts of the base, holding the fastener to such panel, with the catch means being a portion of the fastener displaced from the web, with a catching surface thereof being the nearest part thereof to the base and to the framing member when the fastener is installed on the framing member, and with the catch extending from the web in a direction toward the fastener base and opposite to that in which the tab member extends from the web.

10. A mounting means according to claim 9 wherein the fastener comprising the catch member is of spring steel, the catch is substantially triangular in shape, with the catching surface thereof being a rounded corner of said triangle, the catch is separated from web portions and tab portions, between which it is located, and the portion of the base which contacts the back of the first panel to which the fastener is held is in two parts, each of which is shaped substantially like the openings between the catch member and the webs and in the tab.

11. A mounting means according to claim 10 wherein the end of the tab is bent over on itself to rigidify it and to improve holding of the fastener to the panel, and the base includes a slot for passage of a holding means to hold the fastener to the framing member, which slot extends horizontally when the panels are rectangular and are installed with the lengths thereof being vertical.

12. A mounting means according to claim 1, which is adapted for mounting kerfed panels, having kerfs at sides thereof, to a framing member, wherein the fastener comprising the latch member is made of a single piece of material and comprises a base, for contacting a framing member and a major back surface of a second panel on which the latch member is to be installed, a web, extending from the base and away from the framing member, when installed, at about a right angle from the base, a tab, extending at about a right angle from the web so as to be capable of fitting in the kerf in the side of the panel, and a latch member which is an extension or a part of the base and has an opening in the web adjacent to it to facilitate bearing of the catch member on the latch member, when both catch and latch fasteners are installed on the panels and the panels are installed in positively locking relationship.

13. A mounting means according to claim 12 wherein the tab of the fastener comprising the latch member is bent over on itself at an end thereof, a portion of the base is bent over on itself, with the end of such bent over portion being in contact with the framing member and forming a strengthened latch member, and the end of the base away from the latch member is ribbed.

14. A mounting means according to claim 13 wherein the fastener comprising the latch portion is of spring steel, the base portion of the fastener containing the latch includes a slot which, when the mounting means is installed on vertically installed rectangular wall panels and held to a framing member, extends vertically and overlies a portion of a slot extending transversely to it, which is present in the fastener containing the catch member.

15. A wall, comprising a plurality of wall panels held together, and to framing members, with sides abutting, in readily separable positively locked relationship, by a plurality of mounting means according to claim 1.

16. A wall according to claim 15 wherein the fasteners on the sides of each panel are different, those on one side of the panel being catch fasteners and those on the other side being latch fasteners.

17. A wall according to claim 15 wherein the fasteners on both sides of each panel are the same, either all latch fasteners or all catch fasteners.

18. A method of readily disengaging a pair of abutting sides of abutting first and second panels of a wall in accordance with claim 15, the side of the first panel having fasteners containing catch members on it and the side of the second panel having fasteners containing latch members on it, which comprises inserting a separating member between such sides of the abutting panels and between the catch and latch fastener so that the catch and latch members thereof are disengaged, and repeating such operation until the plurality of mounting means holding such panels in abutting relationship at such sides thereof have been disengaged, which releases the second panel from the first panel and from the framing member to which the first panel is held.

19. A method according to claim 18 wherein after the second panel is disengaged from the first panel in the manner described the second panel is removed from the wall by moving it in the direction of the first panel and in front of it.

20. A method according to claim 19 wherein the second panel is removed from the wall with the latch fasteners remaining held to the panel sides and with the catch fasteners, which hold the other side of the second panel to the framing member when the wall is complete, remaining held to the framing member.

* * * * *